US005886727A

United States Patent [19]

Dobashi et al.

[11] Patent Number: 5,886,727

[45] Date of Patent: Mar. 23, 1999

[54] THERMAL TRANSFER PRINTER AND PRINTING METHOD THEREFOR

[75] Inventors: Koichi Dobashi; Hiroyoshi Zama, both of Morioka; Isao Ohwada; Takashi Goto, both of Takizawa-mura; Toshiaki Amano, Morioka, all of Japan

[73] Assignee: Alps Electric Co., Ltd., Tokyo, Japan

[21] Appl. No.: 476,949

[22] Filed: Jun. 6, 1995

[30] Foreign Application Priority Data

| | | | |
|---|---|---|---|
| Jun. 8, 1994 | [JP] | Japan | 6-126162 |
| Jun. 15, 1994 | [JP] | Japan | 6-132790 |
| Jul. 19, 1994 | [JP] | Japan | 6-167021 |

[51] Int. Cl.[6] ..... B41J 2/325; B41J 31/00; G01D 15/16

[52] U.S. Cl. ..... 347/213

[58] Field of Search ..... 347/103, 213; 399/286, 165, 333, 318, 124; 346/136, 138; 427/469

[56] References Cited

U.S. PATENT DOCUMENTS

| | | | |
|---|---|---|---|
| 5,448,282 | 9/1995 | Imai et al. | 347/213 |
| 5,532,724 | 7/1996 | Inagaki et al. | 347/213 |

FOREIGN PATENT DOCUMENTS

| | | |
|---|---|---|
| 61-272174 | 2/1986 | Japan . |
| 6-47935 | 2/1994 | Japan . |

*Primary Examiner*—N. Le
*Assistant Examiner*—L. Anderson
*Attorney, Agent, or Firm*—Brinks Hofer Gilson & Lione

[57] ABSTRACT

A thermal transfer printer of the intermediate transfer type that first melts ink of an ink ribbon by heat of a thermal head and subsequently transfers the molten ink onto an intermediate transfer member to thereby form a primary recording image, and finally re-transfers this primary recording image onto paper to thereby perform a desired recording. The intermediate transfer member is made of a material selected in such a manner that the coefficient of friction for this material is equal to or more than 1.0. In one embodiment, the material of the intermediate transfer member is silicon rubber.

19 Claims, 9 Drawing Sheets

THERMAL TRANSFER PRINTER AND PRINTING METHOD THEREFOR

BACKGROUND OF THE INVENTION

1. Field of the Invention

The present invention relates to a thermal transfer printer of the intermediate transfer type that produces a desired record by melting ink from an ink ribbon by heat of a thermal head, then transferring the molten ink onto an intermediate transfer medium so as to form a primary recording image, and finally re-transferring, namely, transferring this primary recording image onto paper and to a printing method therefor.

2. Description of the Related Art

Hitherto, there has been frequently used a thermal transfer printer which produces a record by pressing a thermal head against a platen through paper and an ink ribbon. In the case where such a thermal transfer printer produces a record on paper having large surface roughness, such as bond paper, it is necessary to press the thermal head against the paper put on the platen by applying large pressing force to the thermal head. However, there is a limit to the pressing force, because of the precise structure of the thermal head. Thus, there has been used a thermal transfer printer of the intermediate transfer type that produces a record by partly melting ink from an ink ribbon by heat generated in the thermal head, then transferring the molten ink onto an intermediate transfer medium so as to form a primary recording image on the primary transfer medium, and finally transferring this primary recording image onto paper pressed against the primary transfer medium by the large pressing force of a pressure roller once more.

FIG. 10 shows a part of the configuration of an example of the conventional thermal transfer printer of such a type. As shown in this figure, a platen roller 61 formed like a metallic cylinder, the surface of which is covered with a rubber material serving as an intermediate transfer medium 60, is provided in this printer in such a manner as to be able to be driven rotatably. Thermal head 62 is provided in the vicinity of the platen roller 61. This thermal head 62 has a plurality of heating elements aligned in such a manner as to face the central portion of the platen roller 61. A pair of ribbon rolls 65 and 65*a*, between which an ink ribbon 64 wound around a bobbin 63 is guided in a nearly linear manner through the platen roller 61 and the thermal head 62, are provided on both sides of this thermal head 62, respectively. Further, a ribbon feeding mechanism is provided halfway between the thermal head 62 and the take-up ribbon roll 65*a*. The ribbon feeding mechanism consists of a pinch roller 66, a ribbon guide shaft 67 for guiding the ink ribbon 64 in such a way as to be fed around the pinch roller 66, and a motor (not shown) for driving the pinch roller 66 to rotate. The speed of feeding the ink ribbon is controlled by driving the pinch roller 66 in such a manner as to become constant.

Moreover, a pressure roller 68 to be pressed against the platen roller 61 under large pressing force or pressure is rotatably provided at a position which is symmetric to the position of the thermal head 62 with respect to the center of the circular transverse section of the platen roller 61. A predetermined kind of paper 69 such as plain paper is inserted into a gap between the platen roller 61 and the pressure roller 68. The paper is put between the platen roller 61 and the pressure roller 68 and is further fed in the direction opposite to a direction, in which the ink ribbon 64 is fed, by driving the platen roller 61 to rotate.

In the case of this thermal transfer printer, when the paper 69 is inserted into the gap between the platen roller 61 and the pressure roller 68, the pressure roller 68 is first pressed against the platen roller 61 under large pressing force or pressure. Further, while the printer is in such a state, the pinch roller 66 is driven to rotate so as to feed the ink ribbon 64 at a constant speed. Moreover, while taking up the ink ribbon 64 by driving a take-up bobbin 63 to rotate, each of the heating elements is caused to generate heat according to a desired recording signal. Then, the paper 69 is fed by driving the platen roller 61 to rotate. Furthermore, part of ink from the ink ribbon 64 is melted by selectively causing the heating elements of the thermal head 62 to generate heat. Then, the molten ink is transferred onto the surface of the platen roller 61. Subsequently, a first recording image formed on the surface of the intermediate transfer medium 60 in this way is re-transferred onto the fed paper 69 by the pressing force of the pressure roller 68. Consequently, a desired record is obtained.

Meanwhile, the pinch roller 66 is provided in the printer for the following purpose.

Namely, regarding the feeding of the ink ribbon 64, in the case where a rubber material, of which the smoothness (or surface roughness) in terms of $R_{max}$ is not less than 50 $\mu$m and the hardness is not less than 60 degrees, is used as the intermediate transfer medium 60, the adhesion of which is represented in terms of the smoothness and the hardness (what is called JIS (Japanese Industrial Standards) hardness) when feeding the ink ribbon 64 by driving the platen roller 61 pressed against the ink ribbon 64 to rotate, a slippage occurs between the platen roller 61 and the ink ribbon 64 and thus the operation of feeding the ink ribbon can not be achieved well if a printing is performed on condition that the head pressing force P of the thermal head 62 is 100 to 300 g/cm$^2$. Further, in the case where the ink ribbon 64 is fed by driving the take-up ribbon roll 65*a* to rotate, the speed of the fed ink ribbon 64 changes according to the outside diameter of the take-up ribbon roll 65*a* and thus it can not be expected that a uniform resultant record is obtained. Therefore, the pinch roller 66 is provided in the printer as a means for controlling the speed of the fed ink ribbon 64 in such a manner that the ink ribbon 64 is stably fed at a constant speed.

Further, when designing the mechanisms of the printer of this type, for the purpose of preventing the fed ink ribbon from becoming loose, such an ink-ribbon feeding speed is set in such a manner that a speed $V_1$, at which the ink ribbon 64 is fed by rotating the pinch roller, is a little higher than a speed $V_0$ at which the ink ribbon 64 is fed by rotating the platen roller.

The precision of writing or printing is, however, determined according to the rotating speed of the platen roller 61. Even in the case where the ink-ribbon feeding speed is adjusted to the writing speed on the basis of calculation, the thickness of the transferred ink can not be made to be constant owing to the subtle difference in rotating speed between the platen roller and the pinch roller if the outside diameters of the platen roller 61 and the pinch roller 66 vary even in small lengths within the accuracies of such components.

Further, if the speed $V_1$ is higher than the speed $V_0$, slippage occurs between the ink ribbon 64 and the platen roller 61 in the case of using the intermediate transfer medium 60, of which the $R_{max}$ is not less than 50 $\mu$m and the hardness is not less than 60 degrees, as described above. A result of an experiment proves that slippage occurs if the coefficient of friction for the intermediate transfer medium 60, which may change according to the kinds of rubber materials applied to the surface 7 and the platen roller 61, is about 0.95 or less.

Moreover, components associated with the pinch roller 66, as well as a driving-force source therefor, become necessary. Consequently, the cost of the printer becomes high. In addition, the miniaturization of the thermal transfer printer can not be achieved.

Further, FIG. 11 shows a sectional view of a part of another conventional thermal transfer printer of the intermediate transfer type. In this thermal transfer printer, a cylindrical platen roller 73 is provided in such a manner as to face heating elements of a thermal head 71 through an ink ribbon 72. In this platen roller 73, a first heater 75 for heating an intermediate transfer medium 74 through the platen roller 73 is provided. Moreover, a cylindrical back-up roller 78 is provided therein in such a manner as to face a pressure roller 77, which is adapted to be able to advance and retreat in the directions of arrows B1 and B2, respectively, so as to press printing paper 76 against the intermediate transfer medium 74, through the printing paper 76. In this back-up roller 78, a second heater 79 for heating the intermediate transfer medium 74 through the back-up roller 78 is provided. Further, the intermediate transfer medium 74 is looped around the platen roller 73 and the back-up roller 78 under tension. The intermediate transfer medium 74 and the paper 76 are inserted between the pressure roller 77 and the back-up roller 78.

Hereupon, the thermal head 71 advances and retreats in the directions of arrows A1 and A2, respectively, and thus comes into contact with the intermediate transfer medium 74 through the ink ribbon 72. A position on the intermediate transfer medium 74, onto which an ink layer 80 of the ink ribbon 72 is primarily or initially transferred, is the midpoint position of a portion of the medium fed around a part of the platen roller 73 for heating the intermediate transfer medium 74, which corresponds to an arc L1 illustrated in FIG. 12.

Further, the platen roller 73 and the back-up roller 78 are made of metallic materials and have hollow structures so as to contain the first heater 75 and the second heater 79, respectively. Moreover, the platen roller 73 is connected to a driving means (not shown) and is driven by the driving means to rotate clockwise. As the result of rotating the platen roller 73, the intermediate transfer medium 74 is made to run in the direction of an arrow C. Consequently, the ink ribbon 72 and the paper 76 are made to run in the directions of arrows D and E, respectively.

An operation of the conventional thermal transfer printer with such a configuration will be described hereinbelow. First, the thermal head 71 is moved in the direction of the arrow Al and is pressed against the platen roller 73 through the ink ribbon 72 and the intermediate transfer medium 74. At that time, the platen roller 73 is heated by the first heater 75 contained therein. The intermediate transfer medium 74 is heated through this roller to a temperature T1 at which the ink layer 80 of the ink ribbon 72 does not melt. Then, when a plurality of heating elements of the thermal head 71 are selectively heated, the ink layer 80 of the ink ribbon 72 is transferred onto the intermediate transfer medium as a primary recording image.

Thereafter, when the platen roller 73 is driven by a driving-power source (not shown) to rotate, the intermediate transfer medium 74 looped around the platen roller 73 and the back-up roller 78 under tension is fed in the direction of the arrow C. Simultaneously with this, the ink ribbon 72 is driven by friction between the intermediate transfer medium 74 and this ribbon and is thus fed at a constant speed in the direction of the arrow D.

Subsequently, the ink ribbon 72 is taken up by driving a take-up ribbon roll 82 after the primary transfer of the ink layer 80 onto this ribbon has been finished. At that time, a change in the take-up speed depends on the take-up radius of the ribbon roll 82. Therefore, the take-up speed should be higher than the speed at which the intermediate transfer medium is fed. The change in the take-up speed is, however, accommodated by providing a slipping mechanism (not shown) in a take-up mechanism of the ribbon roll 82.

Further, when the intermediate transfer medium, onto which the ink layer 80 has been primarily transferred as the primary recording image, is fed to a place where this ink layer 80 faces the gap between the pressure roller 77 and the back-up roller 78, the pressure roller 77 presses the printing paper 76 against the primary recording image transferred onto the intermediate transfer medium 74. Then, the intermediate transfer medium 74 is heated by the second heater 79 through the back-up roller 78 to an optimum temperature T2 for re-transferring the primary recording image onto the paper. Moreover, the intermediate transfer medium 74 and the paper 76 are fed in the direction of the arrow E. Thereby, the primary recording image having been transferred onto the intermediate transfer medium 74 is re-transferred onto the paper 76. Thereafter, when the pressure roller 77 is moved in the direction of the arrow B2, the pressure exerted upon the intermediate transfer medium 74 is eliminated. Consequently, the operation of printing image is completed. The printer is adapted to record images by performing the foregoing process repeatedly.

Meanwhile, in the conventional thermal transfer printer, the position, at which the primary recording image is transferred onto the intermediate transfer medium 74 by the thermal head 71, is determined without fully considering a position at which such an image should be primarily transferred thereto. Generally, a place as indicated by a reference character b in FIG. 12 in the middle section of a portion of the intermediate transfer medium 74, which is heated when the medium is being fed around a part of the platen roller 73 corresponding to an arc L1, is often determined as a position at which the primary recording image should be primarily transferred thereto.

However, in the case where the intermediate transfer medium is fed around the platen roller 73 which rotates, such a conventionally determined portion of this medium, which corresponds to the position of the thermal head 71, may not be fully heated by the first heater 75 of the platen roller 73. Namely, sometimes, the temperature of such a portion does not reach an appropriate level at which the ink layer 80 is transferred to the intermediate transfer medium 74.

In other words, because the intermediate transfer medium 74 is not heated by the first heater 75 until the medium 74 is fed to a position at which the medium 74 comes in contact with the platen roller 73, the temperature of the medium 74 is relatively low. After the intermediate transfer medium 74 comes in contact with the platen roller 73, this medium is gradually heated by the platen roller 73 while being fed around the platen roller 73. Consequently, the intermediate transfer medium 74 comes to be heated to a temperature suitable for forming the predetermined primary recording image.

However, at the position b of the conventional thermal head 71, where the ink layer 80 is transferred, the intermediate transfer medium 74 is insufficiently heated because of the fact that the distance between the position b and a position on the platen roller 73, at which the intermediate transfer medium 74 comes in contact therewith. Thus the temperature of the intermediate transfer medium 74 sometimes does not reach the range of appropriate temperature. In such a case, the primary recording image is unreliably transferred onto the intermediate transfer medium 74. Thus, there is a fear that the stable reproducibility of dots cannot be obtained.

Moreover, in the case where a color printing is performed by using such a conventional thermal transfer printer, the color printing is carried out by using, for example, a color ink sheet which is called a multicolor ink sheet containing ink of four colors such as yellow (Y), magenta (M), cyan (C) and black (Bk). Namely, one page (or screen) of an image is first printed on a recording medium by using yellow ink of the color ink sheet. Subsequently, the recording medium having been fed during this printing operation is fed back so as to locate a printing position therein. Furthermore, the beginning of a band or area of magenta (M) ink is located in the color ink sheet. Then, one page (or screen) of the image is printed on the recording medium by using the magenta (M) ink. Thereafter, the image is printed on the recording medium by using cyan (C) ink and black (Bk) ink in this order. In this way, the color image is printed on the recording medium.

However, in the case where a color printing is performed by using the aforesaid thermal transfer printer, the formation of a primary recording image on an intermediate transfer member or medium, as well as the transfer and fixing of the primary recording image, is performed correspondingly to each color. Further, in the case where an image or character is printed in ink of a desired color obtained by overprinting the image or character in ink of a plurality of colors (for instance, the image or character is recorded in orange ink by printing the image in yellow (Y) ink over the image in magenta (M) ink), ink of a color is overcoated with ink of another color. This results in reduction in the smoothness of the surface of the overcoated ink (namely, this results in the uneven surface of the overcoated ink). Further, the conventional thermal transfer printer has problems or drawbacks in that the abrasion resistance (namely, the resistance of ink to peeling at the time of rubbing the surface of a print) is low, that thus the degree of fixation of ink onto a recording medium becomes low and that good printing quality cannot be obtained.

Moreover, the conventional thermal transfer printer has problems or drawbacks in that the reduction in the smoothness of the surface of ink ends in decrease in the abrasion resistance of a recording medium having large surface roughness, for example, what is called Lancaster bond paper, that thus good printing quality can not be obtained, that the reduction in the smoothness of the surface of ink also results in decrease in the light transmittance of overhead projector (OHP) paper (namely, transparent paper) and that when an image printed on the OHP paper is projected on a screen by using an OHP, the projected image becomes somber and thus a clear color tone can not be obtained.

The present invention is accomplished to resolve the aforementioned problems of the conventional thermal transfer printer.

SUMMARY OF THE INVENTION

Accordingly, an object of the present invention is to provide a thermal transfer print which can form ink dots stably on a print medium to thereby secure a high quality printing.

Further, another object of the present invention is to provide a thermal transfer printer which can improve the abrasion resistance of a color print to thereby obtain good printing quality and which can improve the light transmittance in the case of using OHP paper.

Moreover, still another object of the present invention is to provide a thermal transfer printing method by which the abrasion resistance of a color print can be improved, thereby obtaining good printing quality and by which the light transmittance in the case of using OHP paper can be also improved.

Other objects, features and advantages of the present invention will become apparent from the following description of preferred embodiments with reference to the drawings in which like reference characters designate like or corresponding parts throughout several views.

DETAILED DESCRIPTION OF THE PREFERRED EMBODIMENTS

Hereinafter, preferred embodiments of the present invention will be described in detail by referring to the accompanying drawings.

Figure 1:
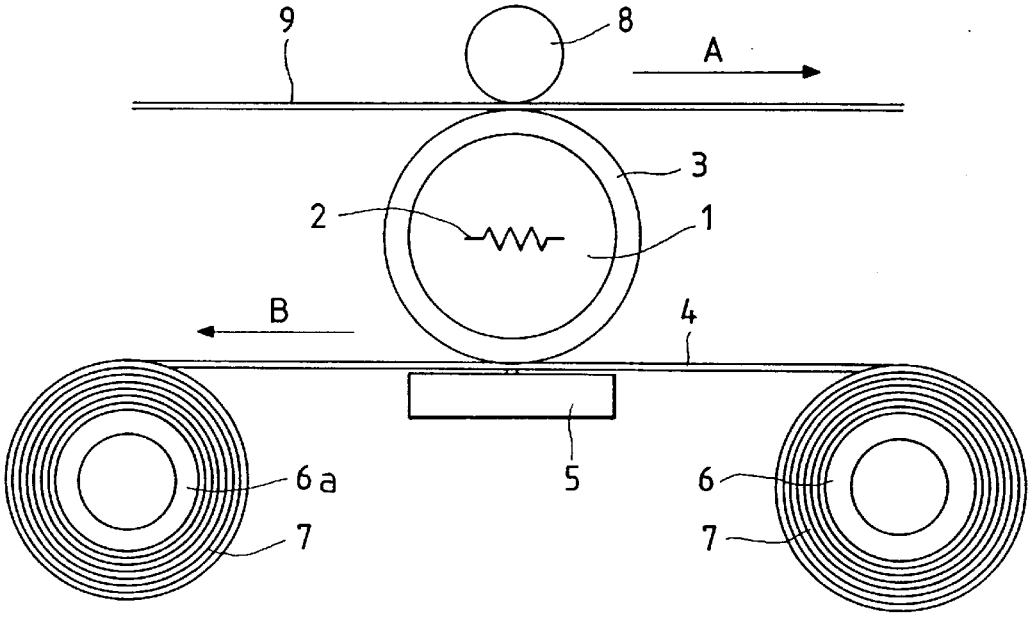
FIG. 1 is a sectional view of a part of a thermal transfer printer, namely, a first embodiment of the present invention.

FIG. 1 is a sectional view of a part of a printer, namely, a first embodiment of the present invention.

In the thermal transfer printer of this embodiment, a cylindrical back-up roller 1 is provided in such a manner as to be able to be driven to rotate. Further, this back-up roller 1 incorporates a heater 2 for heating this back-up roller 1 to a predetermined temperature. The back-up roller 1 is a metallic cylinder, the surface of which is coated with a rubber material (not shown), and is adapted to be able to serve as platen roller. Moreover, the surface of the rubber material of the back-up roller 1 is coated with an adhesive intermediate transfer medium 3. Furthermore, a drive unit (not shown) such as a motor is connected to the back-up roller 1.

Further, the preferable thickness of the rubber material, with which the surface of the back-up roller 1 is covered, ranges from 1 to 2 mm or so. Moreover, experimental data reveals that the optimum thickness of the coat, namely, the intermediate transfer medium 3 ranges from 10 to 500 $\mu$m or so and that the preferable thickness of the intermediate transfer medium 3 ranges from 50 to 200 $\mu$m. Furthermore, this embodiment employs the intermediate transfer medium 3 whose surface roughness represented in terms of $R_{max}$ is not more than 40 $\mu$m and whose hardness complying the JIS ranges from 10 to 40 degrees.

A thermal head 5 is provided in the vicinity of the back-up roller 1. This thermal head 5 has a plurality of heating elements aligned in such a manner as to face the central portion of the back-up roller 1. A pair of ribbon rolls 7 and 7 for guiding an ink ribbon straight from a bobbin 6 to a gap between the back-up roller 1 and the thermal head 5 are provided on both sides of this thermal head 5. Furthermore, a pressure roller 8 to be pressed against the back-up roller 1 under large pressing force or pressure is rotatably provided at a position which is symmetric to the position of the thermal head 5 with respect to the center of the circular transverse section of the back-up roller 1. A predetermined kind of paper 9 such as plain paper is inserted into a gap between the back-up roller 1 and the pressure roller 8. The paper 9 is caught between the back-up roller 1 and the pressure roller 8 and is further fed in the direction opposite to a direction, in which the ink ribbon 4 is fed, by driving the back-up roller 1 to rotate. Incidentally, the ink ribbon 4 to be used for recording or printing is made by covering a base film made of, for instance, resin with ink obtained by mixing a wax component with a colorant.

Next, an operation of this embodiment described hereinabove will be explained hereinbelow.

First, while the paper 9 is inserted into a gap between the back-up roller 1 and the pressure roller 8, the pressure roller 8 is pressed against the back-up roller 1 under large pressing force. Moreover, the thermal head 5 is pressed against the ink ribbon 4 and the back-up roller 1. Furthermore, the back-up roller 1 is heated by the heater 2 contained therein to a temperature T1 at which the ink of the ink ribbon 4 does not melt. Thereafter, a plurality of heating elements of the thermal head 5 are selectively heated. When the printer is in such a state, the back-up roller 1 is driven by a drive unit (not shown) to rotate clockwise. Thereby, the paper 9 is fed in the direction of the arrow A of FIG. 1. Simultaneously with this, the ink ribbon 4 is also fed at a predetermined speed in the direction of the arrow B. Namely, in the case of this embodiment, the ink ribbon 4 is fed by friction between the ink ribbon 4 and the intermediate transfer medium 3 provided around the periphery of the back-up roller 1. Subsequently, the ink ribbon 4 having been fed downstream from the location of the thermal head 5 is taken up by driving a take-up bobbin 6*a* (by means of a driving power source (not shown)) to rotate. At that time, the take-up speed changes depending upon the radius of the ribbon wound around the bobbin 6*a*. Therefore, the rotating speed of the driven bobbin 6 should be a little higher than the speed at which the intermediate transfer medium is fed by rotating the back-up roller 1. The difference between the rotating speeds is, however, accommodated by providing a known slipping mechanism in the take-up mechanism.

At that time, ink of a portion of the ink ribbon 4, which faces heat-producing one of the heating elements, is melted and subsequently, is transferred onto the intermediate transfer medium 3, with which the surface of the back-up roller 1 is covered, to thereby form a primary recording image.

Then, the ink transferred onto the intermediate transfer medium 3 is heated by the heater 2 contained in the back-up roller 1 to a set temperature. Thereby, adhesion occurs in such ink to a certain extent. When the printer is in such a state, the pressure roller 8 presses the paper 9 against the primary recording image transferred onto the back-up roller 1. Subsequently, the primary recording image is re-transferred onto the paper 9 by feeding the paper 9 in such a manner that there occurs no difference between the circumferential speed of the intermediate transfer medium 3 and the speed at which the paper 9 is fed, namely, the paper 9 has no relative velocity with respect to the intermediate transfer medium 3.

Thus, in the case of the thermal transfer printer of this embodiment, the intermediate transfer medium 3 is constituted by an adhesive material. The ink ribbon 4 can be fed by utilizing the driving force of the back-up roller 1 and large frictional force caused between the ink ribbon 4 and the adhesive intermediate transfer medium 3 with which the surface of the back-up roller 1 is coated. The speed at which the ink ribbon 4 is fed can be set to be the rotating speed of the back-up roller 1. Namely, the feeding of the back-up roller 1 can be performed in synchronization with the feeding of the ink ribbon 4. Consequently, this embodiment can prevent deterioration in the recording precision, which would occur owing to the subtle difference between the rotating speed of the back-up roller 1 and the speed at which the ink ribbon 4 is fed.

Further, as described above, the intermediate transfer medium 3 utilizes an adhesive material. Thus, even if the printing is carried out by setting the pressing force P of the thermal head 5 as 100 to 300 g/cm$^2$, the slippage of the ink ribbon does not occur. Consequently, the thickness of ink becomes stably uniform and a clearer recording image can be obtained.

Incidentally, in the case of this embodiment, even if the coefficient of friction for the intermediate transfer medium 3 is measured, the coefficient of friction cannot be accurately measured because the ink ribbon 4 is torn off by tension. It is, however, apparent that the coefficient of friction between the intermediate transfer medium 3 and the ink ribbon 4 is not less than 1.0.

Additionally, the thermal transfer printer of this embodiment does not require a pinch roller which is employed by the conventional thermal transfer printer so as to control the speed, at which the ink ribbon 4 is fed, in a part of the mechanism for taking up the ink ribbon 4. Thereby, the ribbon feeding mechanism can be simplified. The miniaturization of the thermal transfer printer, as well as the reduction in price thereof, can be achieved.

Figure 2:
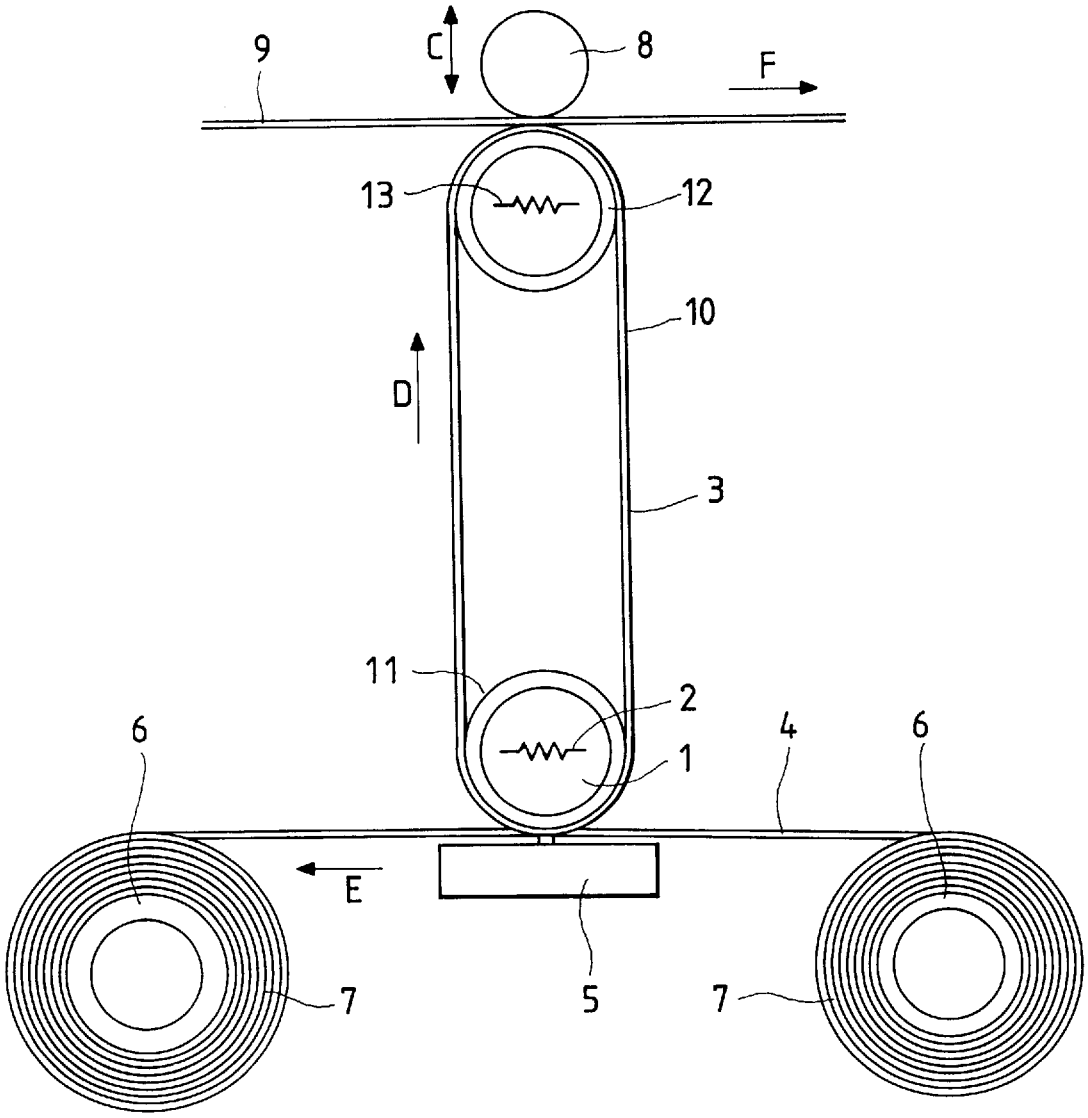
FIG. 2 is a sectional view of a part of another thermal transfer printer, namely, a second embodiment of the present invention.

Further, FIG. 2 is a sectional view of a part of another printer, namely, a second embodiment of the present invention. In this figure, like reference numerals designates like parts of the first embodiment.

An intermediate transfer medium 3 of this thermal transfer printer is formed on the outer surface of an intermediate transfer belt 10 which is a sheet-like endless belt.

A cylindrical platen roller 11 is provided in such a manner as to face heating elements of a thermal head 5 through an ink ribbon 4. In this platen roller 11, a heater 2 for heating the platen roller 11 is provided. Moreover, a cylindrical back-up roller 12 is provided therein in such a manner as to face a pressure roller 8, which is adapted to be able to advance and retreat in the directions indicated by a double-headed arrow C, respectively, so as to press paper 9 against the intermediate transfer belt 10, through the paper 9. In this back-up roller 12, a heater 13 for heating the back-up roller 12 is provided. Further, the intermediate transfer belt 10 is looped around the platen roller 11 and the back-up roller 13 under tension. Thus, the intermediate transfer belt 10 and the paper 9 are inserted between-the pressure roller 8 and the back-up roller 12. Any material, which can hold a primary recording image formed from an ink layer primarily and has a smooth surface, may be employed as the material of the intermediate transfer medium 3 with which the surface of the intermediate transfer belt 10 is covered. Therefore, the intermediate transfer medium 3 can be made of a rubber sheet, a plastic sheet, a metallic sheet or one of combinations of these sheets. For instance, an endless polyimide film, with which the surface of the intermediate transfer belt 10 is covered, may be coated with highly adhesive silicon rubber. In this case, it is most desirable that the thickness of the polyimide film is 50 to 500 $\mu$m and the thickness of the silicon rubber coat is 10 to 500 $\mu$m. More preferably, the thickness of the polyimide film is 50 $\mu$m and that of the silicon rubber coat is 50 to 200 $\mu$m.

Incidentally, results of experiments reveal that the adhesion between the silicon rubber employed as the material of the intermediate transfer medium 3 and the ink ribbon 4 becomes good when the smoothness represented in terms of $R_{max}$ is 10 to 40 $\mu$m and the hardness is 10 to 80 degrees (preferably, 10 to 40 degrees) in the case where the adhesion of the silicon rubber is represented in terms of the smoothness (or surface roughness) and the hardness (particularly, what is called JIS hardness).

The platen roller 11 is connected to a drive means (not shown) and is driven by the driving means to rotate clockwise. As the result of rotating the platen roller 11, the intermediate transfer belt 10 is made to run in the direction of an arrow D of FIG. 2. Consequently, the ink ribbon 4 and the paper 9 are made to run in the directions of arrows E and F, respectively. Moreover, the ink ribbon 4 has a structure similar to that of the ink ribbon of the first embodiment. Incidentally, the platen roller 11 and the back-up roller 12 are made of metal and have hollow structures so as to incorporate the heaters 2 and 13, respectively. Moreover, if necessary, the periphery of each of the platen roller 11 and the back-up roller 12 may be covered with an elastic material such as rubber and thus each of the rollers 11 and 12 may have a two-layer structure.

Next, an operation of this embodiment having the above-mentioned configuration will be described hereinbelow.

First, the thermal head 5 is pressed against the platen roller 11 through the ink ribbon 4 and the intermediate transfer belt 10. At that time, the platen roller 11 is heated by the heater 2 contained therein to a temperature T2 at which the ink of the ink ribbon 4 does not melt. Thereafter, a plurality of heating elements of the thermal head 5 are selectively heated. When the printer is in such a state, the platen roller 11 is driven to rotate clockwise. Thereby, the intermediate transfer belt 10 looped around the platen roller 11 and the back-up roller 12 under tension is made to run. Thus, the back-up roller 12 is rotated. Consequently, the ink ribbon 4 is fed at a constant speed. Namely, in the case of the thermal transfer printer, the ink ribbon 4 is driven by friction between the intermediate transfer medium 3 of the intermediate transfer belt 10 and the ribbon 4, and is thus fed. An operation of taking up the fed ink ribbon 4 is similar to that in the case of the first embodiment. Therefore, the description of the operation of taking up the fed ink ribbon 4 is omitted herein.

When the heating elements of the thermal head 4 produce heat and thus the ink of the ink ribbon 4 partly melts, the molten ink is transferred onto the intermediate medium 3 formed on the surface of the intermediate transfer belt 10. Consequently, a primary recording image constituted by the ink is formed on the surface of the intermediate transfer medium 3.

Subsequently, a part of the intermediate transfer belt 10, on which the primary recording image is held, comes to face a gap between the pressure roller 8 and the back-up roller 12 and moreover, the paper is pressed by the pressure roller 8 against the primary recording image formed on the intermediate transfer medium 3. When the back-up roller 12 for feeding the intermediate transfer medium 3 is heated by the heater 13 to the most appropriate temperature T3 for re-transferring the image onto the paper, the intermediate transfer belt 10 is made to run in the direction of the arrow D and on the other hand, the paper 9 is fed in the direction of the arrow E. Thereby, the printing is finally completed by re-transferring the primary recording image formed on the intermediate transfer belt 10 onto the paper 9. Thereafter, the pressure exerted from the pressure roller 8 upon the intermediate transfer belt 10 is eliminated. The printer is adapted to record images by performing the foregoing process repeatedly.

In the case of the thermal transfer printer having the intermediate transfer belt 10 according to this embodiment, the intermediate transfer belt 10 is made to run by the driving force of the platen roller 11. Moreover, the driving force of the platen roller 11 is transmitted by utilizing the friction force between the ink ribbon 4 and the adhesive intermediate transfer medium 3, with which the surface of the intermediate transfer belt 10 is covered, to thereby perform the feeding of the ink ribbon 4. Namely, the thermal transfer printer of this embodiment is similar to the printer of the first embodiment in that the feeding of the intermediate transfer medium 3 is synchronized with the feeding of the ink ribbon 4 by utilizing the friction force. Thus, the second embodiment can have effects similar to those of the first embodiment.

However, in the case of the second embodiment, the heater 13 is built in the back-up roller 12 provided at a portion where a primary recording image is re-transferred onto the paper 9. In addition to the heating of the platen roller 11, the back-up roller 12 is heated to the most appropriate temperature for re-transferring the primary recording image. Thereby, the temperature environment of this embodiment can be controlled. Consequently, better results of the results can be obtained.

Figure 3:
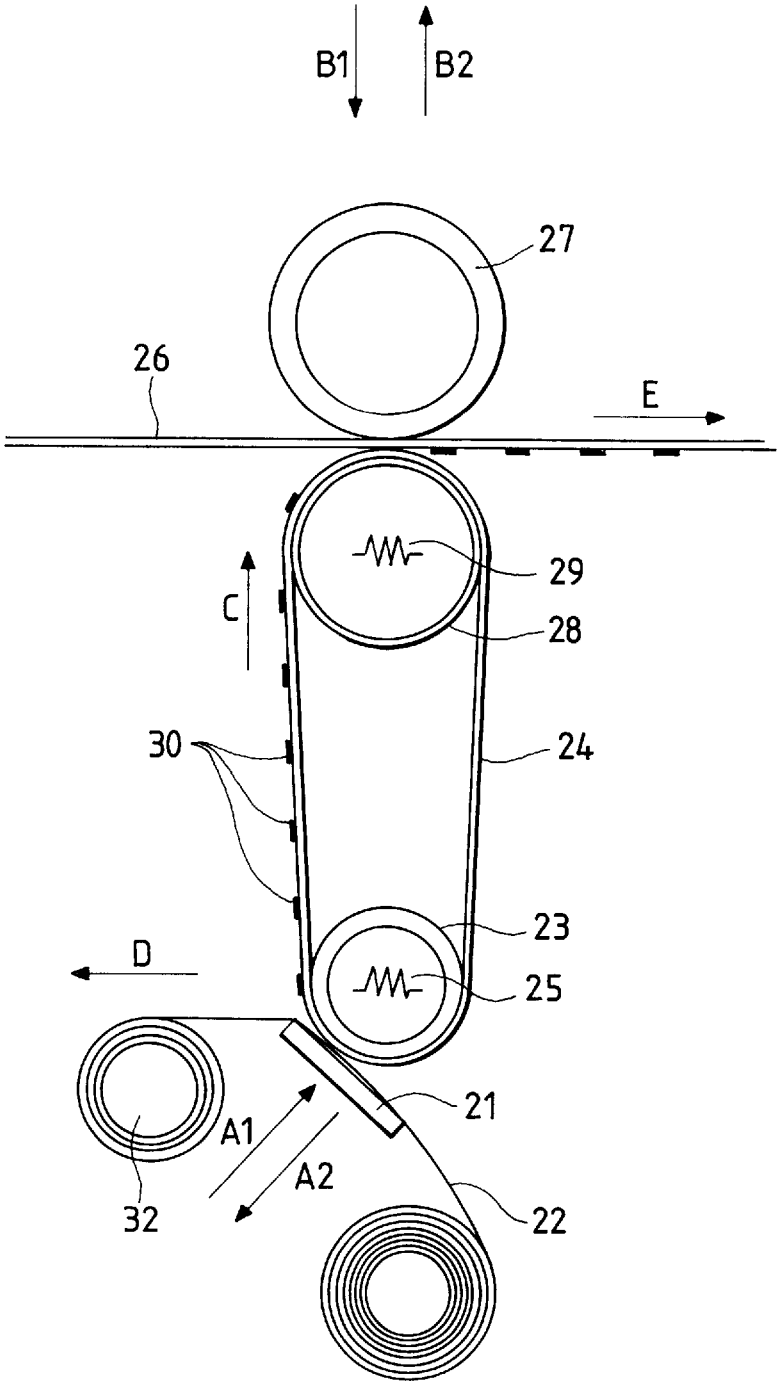
FIG. 3 is a sectional view of a part of still another thermal transfer printer, namely, a third embodiment of the present invention.

FIG. 3 is a sectional view of a part of still another thermal transfer printer, namely, a third embodiment of the present invention. First, in the thermal transfer printer of this embodiment, the thermal head 21 for selectively heating ink layers 30 of an ink ribbon 22 and transferring the heated ink layer onto the intermediate transfer medium 24 as a first recording image is provided in such a manner as to be able to advance and retreat in the directions of arrows A1 and A2, respectively. Further, a platen roller 23 is provided in such a manner as to face this thermal head 21 through the ink ribbon 22. Moreover, the intermediate transfer medium 24 is put around a part of the periphery of this platen roller 23 which contains a first heater 25 for heating the intermediate transfer medium 24 therethrough to an appropriate temperature T1. This appropriate temperature T1 is a temperature suitable for primarily transferring the ink layer 30 of the ink ribbon 22 by means of the thermal head 21.

Thus, when the platen roller 23 is driven by a driving-power source (not shown) to rotate clockwise, the intermediate transfer medium 24 is heated while the medium 24 is fed in the direction of the arrow C. At that time, a transfer position, at which the ink layer 30 of the ink ribbon 22 is transferred onto the intermediate transfer medium 24 by using the thermal head 21, is set as a position where the intermediate transfer medium 24 being fed is heated to a temperature within the range of the appropriate temperature. Practically, in the case of this embodiment, the transfer position is set as being downstream from the middle portion of a part of the intermediate transfer medium 24, which is put around the platen roller 23, in the direction of the arrow D.

Figure 4:
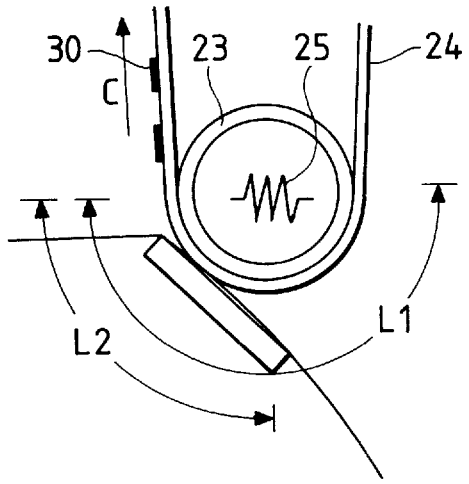
FIG. 4 is a diagram for illustrating a place at which a thermal head is pressed against a platen roller of FIG. 3.
Figure 5:
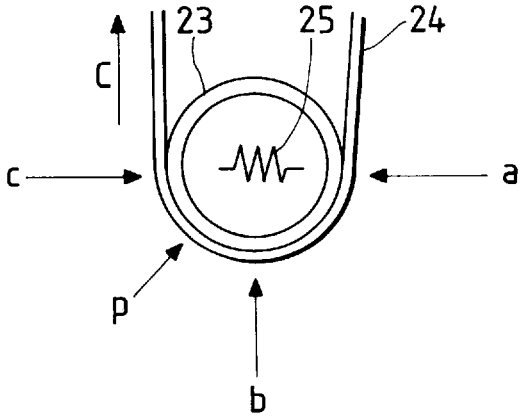
FIG. 5 is a diagram for illustrating change in temperature of a part of an intermediate transfer medium, which is fed around the platen roller.
Figure 6:
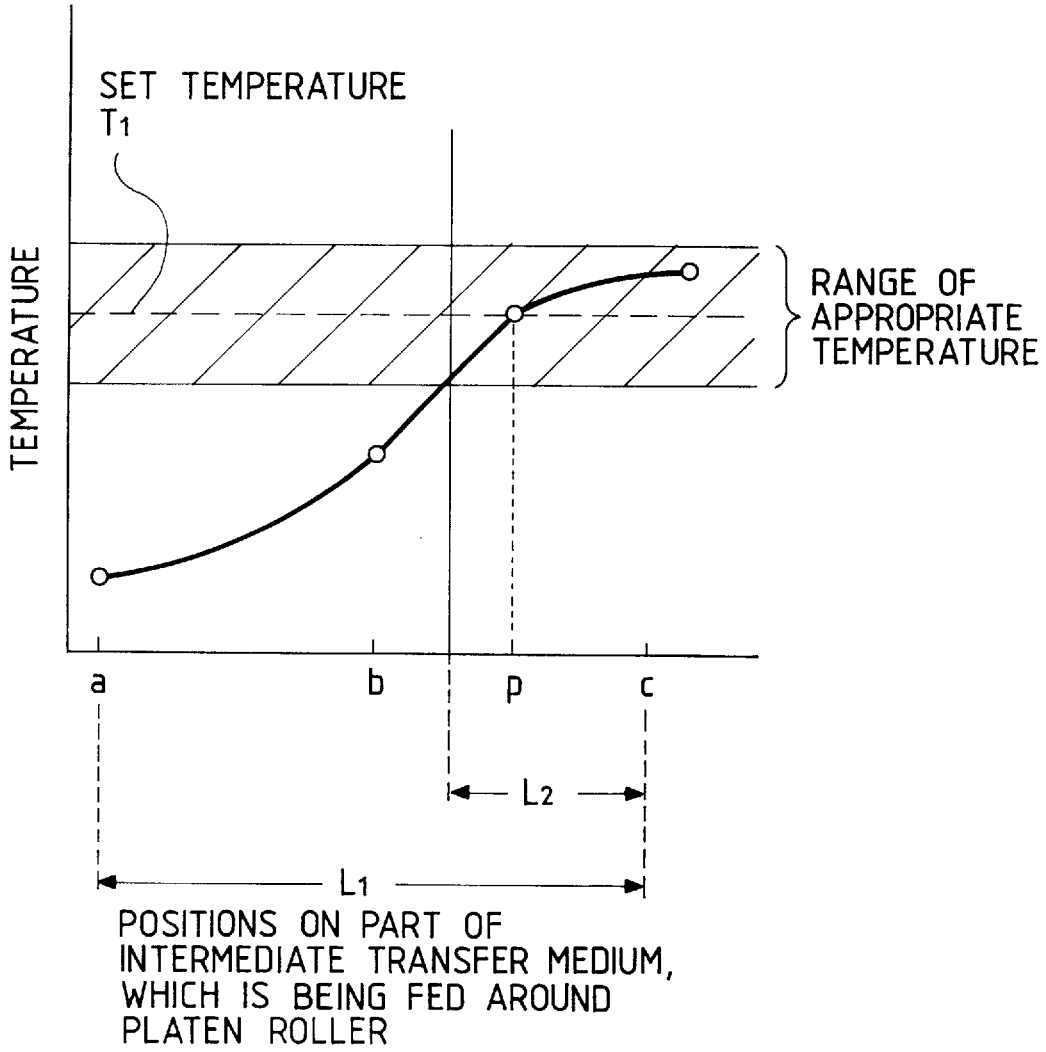
FIG. 6 is a graph for illustrating the temperatures at places on the part of the intermediate transfer medium, which is fed around the platen roller.

This will be described hereunder in detail by referring to FIGS. 4 to 6. FIGS. 4 and 5 are diagrams for illustrating places on a portion of the intermediate transfer medium 24, which is put around a part of the periphery of the platen roller 23. FIG. 6 is a graph for illustrating how the temperature varies with the places on the portion of the intermediate transfer medium 24, which is fed around the platen roller as shown in FIG. 5.

In FIG. 5, reference character a designates the most upstream point on the portion of the intermediate transfer medium 24, which is fed around the platen roller, in the feeding direction at which the medium is fed; b the middle point thereon in the feeding direction; c a most downstream point thereon in the feeding direction; and p the transfer position at which the ink layer 30 is transferred onto the intermediate transfer medium 24 by using the thermal head 21. As is apparent from these figures, the temperature at the point b is closer to a preset temperature than the temperature at the point a. Further, the temperature at the point c is closer to a preset temperature than the temperature at the point b. Moreover, the temperature at the point p becomes equal to the set temperature T1.

This is because of the facts that the intermediate transfer medium 24 is not heated until the medium is put around the part of the periphery of the platen roller, that thereafter, while the medium 24 is fed around the platen roller 23, the medium 24 is heated by the first heater 25 through the platen roller 23 and the temperature of the medium 24 and that thus the temperature of the medium 24 is raised gradually to the set temperature.

Therefore, as the medium is fed more downstream, a larger amount of heat becomes applied to the medium for a longer time.

As is seen from FIGS. 4 to 6, a range, in which the intermediate transfer medium can be fully heated and the temperature thereof can be maintained stably, is that designated by reference character L2. Thus, in the case of this embodiment, the transfer position at which the ink layer 30 is transferred onto the intermediate transfer medium 24 by means of the thermal head 1 is the point p where the temperature of the intermediate transfer medium 24 reaches the set temperature.

On the other hand, a pressure roller 27 for transferring onto printing paper 26 the primary recording image having been transferred onto the intermediate transfer medium 24 fed in the direction of the arrow C is provided in the printer in such a manner as to be able to advance and retreat in the directions of arrows B1 and B2, respectively. A cylindrical back-up roller 28 is placed at a position where the roller 28 faces this pressure roller 27 through the intermediate transfer medium 24 and the printing paper 26. A second heater 29 for heating the intermediate transfer medium 24 through the back-up roller 28 to a desired set temperature is provided therein. Moreover, the intermediate transfer medium 24 is put around a part of the periphery of this back-up roller 28.

Therefore, when the first recording image is fed to a gap between the pressure roller 27 and the back-up roller 28 as the intermediate transfer medium 24 is fed, the printing paper 26 comes to face the first recording image and to be pressed against the back-up roller 28 which is heated to the set temperature.

Further, the platen roller 23 and the back-up roller 28 are made of a metallic material and have hollow structures so as to incorporate the first heater 25 and the second heater 29, respectively. Incidentally, if necessary, an elastic material such as rubber is given to these rollers which thus have two-layer structures.

Moreover, any material, which can hold a primary recording image formed from an ink layer primarily and has a smooth surface, may be employed as the material of the intermediate transfer medium 24. Therefore, the intermediate transfer medium 24 can be made of a rubber sheet, a plastic sheet, a metallic sheet or one of combinations of these sheets. For instance, an endless polyimide film, with which the surface of the intermediate transfer medium 24 is covered, may be coated with highly adhesive silicon rubber. In this case, it is most desirable that the thickness of the polyimide film is 50 to 500 $\mu$m and the thickness of the silicon rubber coat is 10 to 500 $\mu$m. More preferably, the thickness of the polyimide film is 50 $\mu$m and that of the silicon rubber coat is 50 to 200 $\mu$m.

Next, an operation of this embodiment will be described hereinbelow. First, the thermal head 21 is pressed against the platen roller 23 through the ink ribbon 22 and the intermediate transfer medium 24. Moreover, a plurality of heating elements of the thermal head 21 are selectively caused to produce heat. Thereby, the ink layer 30 of the ink ribbon 22 is transferred onto the intermediate transfer medium 24 as a primary recording image. At that time, a transfer position, at which the ink layer 30 of the ink ribbon 22 is transferred onto the intermediate transfer medium 24 by using the thermal head 21, is set as a position where the intermediate transfer medium 24 being fed is heated by the platen roller 23 to a temperature within the range of the appropriate temperature. Thus the first recording image can be securely transferred onto the intermediate transfer medium 24.

Further, when the platen roller 23 is driven by a driving-power source (not shown) to rotate, the intermediate transfer medium 24 looped around the platen roller 23 and the back-up roller 28 under tension is fed in the direction of the arrow C. Simultaneously with this, the ink ribbon 22 is driven by friction between the intermediate transfer medium 24 and this ribbon and is thus fed at a constant speed in the direction of the arrow D.

When the primary recording image is fed to the gap between the pressure roller 27 and the back-up roller 28, the pressure roller 27 presses the printing paper 26 and the intermediate transfer medium 24 against the back-up roller 28. At that time, the intermediate transfer medium 24 is heated by the second heater 29 through the back-up roller 28 to an optimum temperature T2 for re-transferring the primary recording image onto the paper. Thus, as the intermediate transfer medium 24 is fed, the printing paper 26 is fed in the direction of the arrow E. Thereby, the primary recording image having been transferred onto the intermediate transfer medium 24 is re-transferred onto the printing paper 26. Consequently, a final print is obtained. Thereafter, when the pressure roller is moved in the direction of the arrow B2, the pressure exerted upon the intermediate transfer medium is eliminated.

In the case of such a third embodiment, when the ink layer 30 of the ink ribbon 22 is primarily transferred by means of the thermal head 21 onto the intermediate transfer medium 24, the intermediate transfer medium 24 is fully heated by the platen roller 23. Thus the temperature of the medium 24 becomes appropriate and stable. As a result, there is no necessity of increasing the diameter of the platen roller 23 so as to enlarge the range to be heated. Moreover, the ink layer 30 can be securely transferred onto the intermediate transfer medium 24. Consequently, dots can be stably formed and high quality printing can be achieved.

Figure 7:
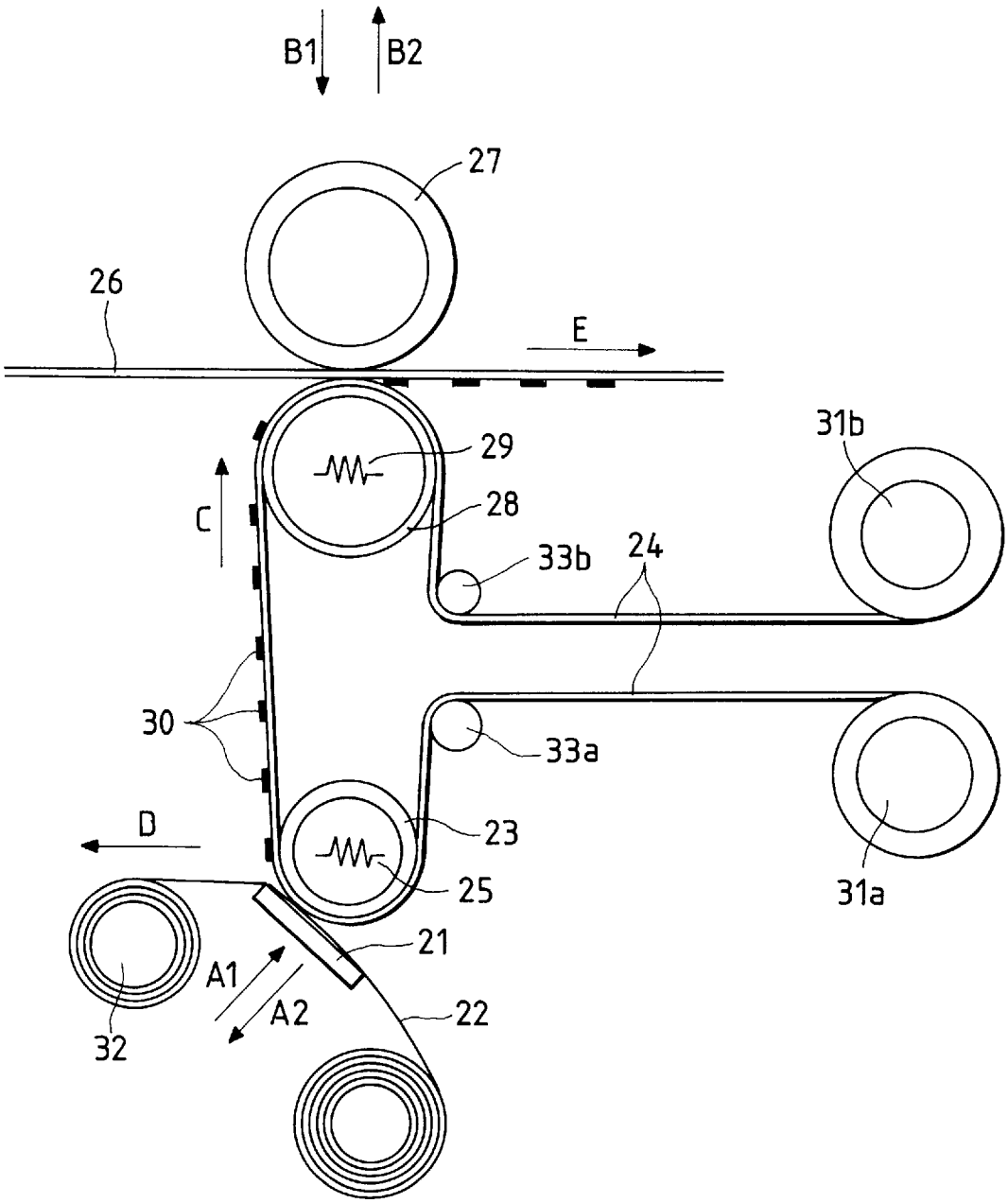
FIG. 7 is a sectional view of a part of yet another thermal transfer printer, namely, a fourth embodiment of the present invention.

Referring next to FIG. 7, there is shown yet another thermal transfer printer, namely, a fourth embodiment of the present invention.

In the case of this embodiment, the intermediate transfer medium 24 is shaped like a long sheet. The intermediate transfer medium 24 having been an unwinding bobbin 31*a* is fed to a tension roller 33*a*, a platen roller 23, a back-up roller 28 and a tension roller 33*b* in this order. Finally, the medium 24 is taken up by a take-up bobbin 31*b*. Incidentally, the rest of the fundamental configuration and an operation of this embodiment are similar to those of the third embodiment. Namely, the transfer position, at which the ink layer 30 of the ink ribbon 22 is transferred onto the intermediate transfer medium 24 by using the thermal head 21, is set as the position of the point p (see FIG. 5), at which the temperature of the intermediate transfer medium 24 is within the range of appropriate temperature as the result of being heated by the platen roller 23. This thermal head 21 selectively heats the ink ribbon 22 put on the intermediate transfer medium 24. Thereby, a primary recording image is formed from the ink layer 30. Moreover, this primary recording image is fed to the gap between the pressure roller 27 and the back-up roller 28. Furthermore, the primary recording image is re-transferred onto the recording or printing paper 26 by heat from the back-up roller 28 and by pressing force or pressure from the pressure roller 27. Consequently, the printing is completed.

Incidentally, in the case of the fourth embodiment, after the intermediate transfer medium 24 is taken up by the take-up bobbin 31*b*, it is necessary for continuing the printing to rewind the medium 24 to an initial unwinding position by using the unwinding bobbin 31*a*.

Therefore, in accordance with the fourth embodiment having such a configuration, the primary recording image formed from the ink layer 30 can be securely transferred onto the intermediate transfer medium 24. High quality printing can be ensured. As the result of employing the intermediate transfer medium 24 of the sheet type, the sufficient length of each sheet of the intermediate transfer medium 24 can be secured. Thereby, the frequency of usage of a specific portion of the intermediate transfer medium 24 can be decreased. Consequently, the life of the intermediate transfer medium 24 can be increased.

Figure 8:
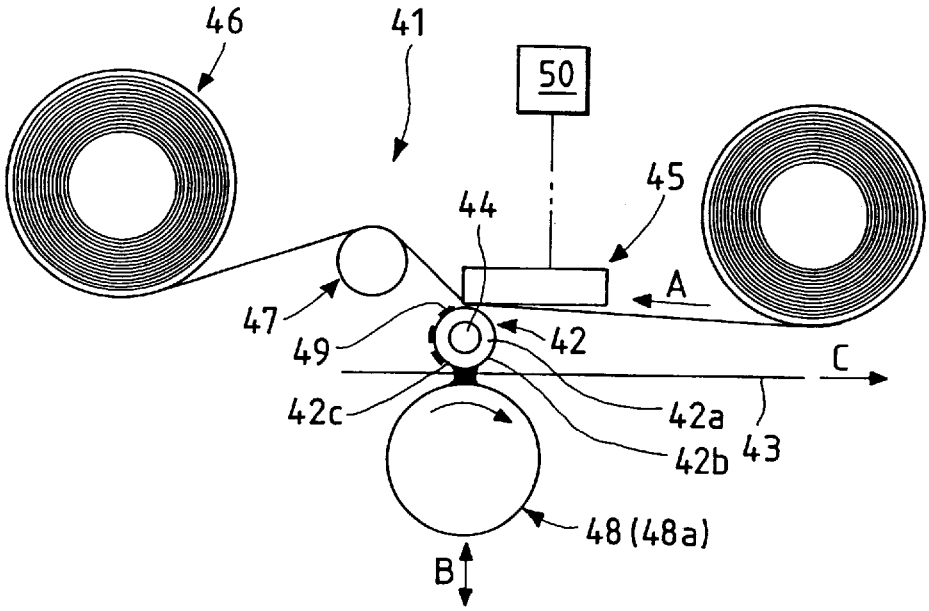
FIG. 8 is a schematic diagram for illustrating a primary part of a thermal transfer line printer, to which a printing method of the present invention is applied, namely, a fifth embodiment of the present invention.

FIG. 8 is a schematic diagram for illustrating a primary part of a thermal transfer line printer, to which a printing method of the present invention is applied, namely, a fifth embodiment of the present invention.

As shown in FIG. 8, in the case of the thermal transfer line printer of this embodiment, an intermediate transfer roller 42 serving as an intermediate transfer member having the function of a cylindrical platen called a transfer platen is provided in the body (not shown) of the line printer. The driving force is transmitted from a driving-force source (not shown), such as a step motor, provided in the body of the printer to this intermediate transfer roller 42 which thus comes to be able to rotate. Further, the intermediate transfer roller 42 has a nearly-cylindrical metallic roll 42*a*. A rubber layer 42*b* having a smooth surface, the thickness of which is 1 or 2 mm, is formed on the periphery of this metallic roll 42*a*. Moreover, the surface of the rubber layer 42*b* is coated with an intermediate transfer medium 42*c* which is 10 to 500 $\mu$m (preferably, 100 to 200) in thickness. Furthermore, a heater 44 for heating the intermediate transfer roller 42 is provided in the metallic roll 42*a*. This heater 44 heats the intermediate transfer roller 42 under the control of a control portion 50 (to be described later) in such a manner that the surface temperature of the intermediate transfer roller 42 becomes 40 to 90 degrees centigrade (preferably, 50 to 60 degrees centigrade) when printing operation. It is most important that the surface temperature of this intermediate transfer roller 42 is lower than the melting point or temperature of the ink. Incidentally, the surface temperature of this intermediate transfer roller 42 may be determined by taking the characteristics such as the melting point of ink into consideration. Thus, the surface temperature of the intermediate transfer roller 42 is not limited to the surface temperature employed in this embodiment. Moreover, this printer may have an endless belt-like rotatable intermediate medium as an intermediate transfer member. Thus, the intermediate transfer member is not limited to the medium as employed in this embodiment.

Above the intermediate transfer roller 42, a line thermal head 45 is placed in such a manner as to be able to approach and leave the intermediate transfer roller 42. This line thermal head 45 extends in the direction parallel to the axis of rotation of the intermediate transfer roller 42. Moreover, a plurality of heating elements (not shown) are aligned in the line thermal head 45 over the length corresponding to the size in the direction of a row or line of the recording range of the recording medium 43 and can be selectively caused to produce heat according to printing information. Furthermore, an abutting position, at which this line thermal head 45 is brought into abutting engagement with the intermediate transfer roller 42, is set as a transfer position at which ink of a color ink sheet called a multicolor ink sheet (to be described later) is transferred onto the intermediate transfer roller 42.

A color ink sheet 46 having a width corresponding to the printing width, which is the size in the direction of a row or line of the recording range of the recording medium 43 (to be described later), is supplied to the gap between the intermediate transfer roller 42 and the line thermal head 45. This color ink sheet 46 is adapted to be able to run from the right to the left, namely, in the direction of the arrow A, as viewed in this figure, each time a printing operation in the direction of the line of the recording range of the recording medium 43 is finished. As the intermediate transfer roller 42 rotates, the color ink sheet 46 is unwound from an unwinding bobbin or bin provided at the right side of the intermediate transfer roller 42 by driving force of a driving force source (not shown) and is sequentially taken up by a take-up bobbin provided at the left side of the intermediate transfer roller 42, as viewed in this figure.

Further, areas respectively corresponding to one page (or screen) of the surface of the color ink sheet 46, which faces the intermediate transfer roller 42 when this sheet is at the transfer position, are repeatedly coated with thermally melting ink of colors, namely, yellow (Y), magenta (M), cyan (C) and black (Bk), in this order, respectively. Moreover, a discriminating marker (not shown) for discriminating among these colors and locating the beginning of each of such areas is provided at the beginning of a boundary portion in the running direction of each color ink area. This discrimination marker may be provided only at the beginning of an area of yellow (Y) ink. Thus, the discriminating marker is not limited to that employed in this embodiment.

Moreover, a peeling roller 47 for peeling the color ink sheet 46 from the intermediate transfer roller 42 is placed at a downstream position in the direction, in which the color sheet 46 runs, from the transfer position.

Under the intermediate transfer roller 42, a rotatable pressure roller 48*a* made of metal is provided as a pressing means 48. This pressure roller 48*a* extends in the direction parallel to the axis of rotation of the intermediate transfer roller 42 and is adapted to be able to approach and leave the intermediate transfer roller 42 as indicated by the double-headed arrow B in this figure.

Incidentally, a metallic roller, which has a circular transverse section and a periphery covered with rubber, may be employed as the pressure roller 48*a*. Thus, the pressure roller is not limited to that 48*a* of this embodiment. Furthermore, the intermediate roller 42 and the pressure roller 48*a* may be constructed in such manner that one of these rollers drives and conversely, the other of these rollers is driven. Thus, the intermediate transfer roller and the pressure roller are not limited to the rollers 42 and 48*a* of this embodiment.

A recording medium 43 such as paper and OHP paper is adapted to be supplied to the gap between the intermediate transfer roller 42 and the pressure roller 48*a*. This recording medium 43 is supplied from the left side of the intermediate transfer roller 42 thereto as indicated by the arrow C in FIG. 8. Moreover, the recording medium 43 is adapted to be able to pass through the gap between the intermediate transfer roller 42 and the pressure roller 48*a* and to run to the right side of the intermediate transfer roller 42. Furthermore, the abutting force of the pressure roller 48*a* brought into abutting engagement with the intermediate transfer roller 42, which depends on the material ink, the transfer temperature at which ink is transferred (again), the hardness of the intermediate transfer roller 2 and so on, is not less than 1 Kg/cm or so. Additionally, the primary recording image 49 transferred from the color ink sheet 46 onto the intermediate transfer roller 42 is re-transferred onto the recording medium 43 at the transfer position by heat from the heater 44 and by pressure from the pressure roller 48*a*. Then, the primary recording image is fixed.

Further, the control portion 50 for controlling an operation of each of the portions of the printer is provided in the body (not shown) of the printer. This control portion 50 is operative to control an operation of each of the portions of the printer according to the printing information or the like, namely, control at least a heat-producing operation of each heating element of the line thermal head 45, a rotating operation of the intermediate transfer roller 42, an operation of energizing the heater 44 (namely, an operation of heating the intermediate transfer roller 42), a running operation of the color ink sheet 46, a running operation of the recording medium 43, the pressure roller's operations of approaching and leaving the intermediate transfer roller 42. Moreover, this control portion 50 feeds back the recording medium 43 once in the direction opposite to the normal running direction (namely, the feeding direction). Then, the control portion 50 causes the recording medium 43 to run in the normal running direction. Thereby, the image transferred onto the recording medium 43 is re-heated and re-pressed, namely, heated and pressed again. Moreover, the number of times of re-heating and re-pressing is set as an optimum number predetermined according to the kind of the recording medium 43. Furthermore, the heating temperature, to which the image transferred onto the recording medium 43 is re-heated when re-heating and re-pressing the image, is set as a temperature which is not higher than the melting point of ink but is higher than the temperature, at which the image is heated when transferring the primary recording image 49 onto the recording medium 43, 10 degrees centigrade or so. In this way, it is controlled how the heater 44 is energized.

Next, an operation of this embodiment having the aforementioned configuration, as well as a printing method of the present invention therefor, will be described hereunder.

A (color) printing operation of the thermal transfer line printer of this embodiment is started by locating the beginning of the area or band of ink of a color in the color ink sheet 46. Namely, in order to print an image in first color, the color ink sheet 46 is caused by the driving force from the driving-force source (not shown) to run. Then, the discriminating mark provided at the beginning of the area of yellow (Y) ink in the running direction of the color ink sheet is detected by a detecting means (not shown). Subsequently, the detected beginning of the area, onto which yellow ink is applied, is placed at the transfer position. Further, during the printer is in this state, the line thermal head 45 is put into abutting engagement with the intermediate transfer roller 42. The color ink sheet 46 is held and pressed between the line thermal head 45 and the intermediate transfer roller 42. Moreover, heat sufficient to raise the temperature of the color ink sheet 46 to a level, at which the ink does not melt, is given thereto by the heater 44 provided in the intermediate transfer roller 42.

Subsequently, as the intermediate transfer roller 42 rotates counterclockwise, the color ink sheet 46 is driven by friction to run to the left and is sequentially taken up to the left side as indicated by the arrow A in this figure. Moreover, during the printer is in this state, heating elements (not shown) of the line thermal head 45 are selectively caused according to the printing information to produce heat. Then, the yellow (Y) ink of the color ink sheet 46 softens or melts. Further, the softened or molten ink is transferred onto and is held on the surface of the intermediate transfer roller 42. Thus the primary recording image 49 is sequentially formed on the surface of the intermediate transfer roller 42. Furthermore, when an operation of forming the primary recording image 49 is initiated, the pressure roller 48*a* is brought into abutting engagement with the intermediate transfer roller 42. The recording medium 43 is then supplied to the abutting position at which the intermediate transfer roller 42 is put into abutting engagement with the pressure roller 48*a*.

Further, as the intermediate transfer roller 42 rotates, the primary recording image 49 formed on the surface of the intermediate transfer roller 42 is moved to the abutting position at which the intermediate transfer roller 42 is put into abutting engagement with the pressure roller 48*a*. At this abutting position, the primary recording image 49 is brought into abutting engagement with the recording medium 43 caught between the intermediate transfer roller 42 and the pressure roller 48*a*. Further, the primary recording image 49 is then heated and pressed by heat from the intermediate transfer roller 42, which has been heated by the heater 44, and by pressure from the pressure roller 48*a* and is sequentially re-transferred onto the recording medium 43. Finally, the fixation of the primary recording image 49 is performed. Thus, the printing of the entire of one page (or screen) of the image on the recording medium 43 in first color ink, namely, in yellow (Y) ink is finished.

Next, the control portion 50 performs a control operation. Thereby, the line thermal head 45 is released from the intermediate transfer roller 42 and the color ink sheet 46 is caused to run. Then, the discriminating mark provided at the beginning of the area of magenta (M) ink, which is used in the next printing operation, in the running direction of the color ink sheet is detected by the detecting means (not shown). Subsequently, the detected beginning of the area, onto which magenta (M) ink is applied, is placed at the transfer position. Thus the beginning of the area of second color of the color ink sheet is performed. Further, the control portion 50 performs another control operation. Thus the part of the recording medium 43, which has been made to run during the completed printing operation corresponding to the first color, is fed back. Incidentally, as the result of this feeding-back of the recording medium, the image printed in the first color ink (namely, yellow (Y) ink) and fixed onto the recording medium 43 comes to be re-heated and re-pressed. By performing these operations, the recording medium 43, on which the image of the first color (Y) ink is formed, is returned to a print starting position or state. Moreover, similarly as in the case of the printing in the first color ink, the printing of the entire of one page (or screen) of the image on the recording medium 43 in second color ink, namely, in magenta (M) ink is performed. Thereafter, similarly, the printing of the page (or screen) of the image on the recording medium in cyan ink and that of the page (or screen) of the image thereon in black ink are performed in this order.

Further, upon completion of the operations of printing of the image on the recording medium 43 respectively corresponding to four kinds of color ink, namely, yellow (Y) ink, magenta (M) ink, cyan (C) ink and black (Bk) ink, the control portion 50 performs another control operation so as to release the line thermal head 45 from the intermediate transfer roller 42. Thereby, the recording medium 43 is fed back and is further returned to the print starting position or state. Subsequently, the control portion 50 performs still another control operation to thereby maintain a state in which the line thermal head 45 is released from the intermediate transfer roller 42 (namely, the primary recording image 49 is not formed). Then, the intermediate transfer roller 42 is rotated anticlockwise, and the recording medium 43 is re-heated and re-pressed again and again a number of times corresponding to the number of the kinds of the recording medium 43. Upon completion of the operations of re-heating and re-pressing the recording medium 43 again and again, the recording medium 43 is ejected to the right side of the intermediate transfer roller 42. The printing operation is finished. The number of times of heating and pressing the recording medium 43 is set in accordance with commands or the like from the control portion 50 and according to the kinds of the recording medium 43. For example, in the case where OHP paper or Lancaster bond paper having large surface roughness is used, such a number of times is 2 in this embodiment. Additionally, the heating temperature, to which the image transferred onto the recording medium 43 is re-heated when re-heating and re-pressing the image, is preferably set in accordance with commands or the like of the control portion 50 as a temperature which is not higher than the melting point of ink but is higher than the temperature, at which the image is heated when transferring the primary recording image 49 onto the recording medium 43, 10 degrees centigrade or so.

Upon completion of the printing of the image by using four kinds of color inks in this manner, the recording medium, on which the image has been formed, can be re-heated and re-pressed. Thereby, the adhesion between the recording medium and the ink fixed thereto can be improved. Further, even if paper having large surface roughness is used, the surface of the ink can be made to be smooth. The abrasion resistance (namely, the resistance of ink to peeling at the time of rubbing the surface of a print) can be securely improved. Further, good printing quality can be obtained. Moreover, because the surface of ink becomes smooth, the light transmittance of OHP paper can be improved in the case where OHP paper is used as the recording medium 43. Clear color tone of an image printed on OHP paper at the time of projecting the image on a screen can be obtained. Furthermore, the number of times of re-heating and re-pressing can be changed according to the kind of the recording medium 43. Thus the optimum printing quality can be obtained correspondingly to each of the kinds of the recording medium 43. Additionally, the degree of the fixation of ink onto the recording medium 43 can be securely increased by setting the heating temperature of the recording medium at the time of re-heating and re-pressing as being higher than the heating temperature at the time of transferring the primary recording image 49 onto the recording medium 43. The abrasion resistance (namely, the resistance of ink to peeling at the time of rubbing the surface of a print) can be more securely improved. Further, higher printing quality can be obtained.

Incidentally, the operation of re-heating and re-pressing is performed in the fifth embodiment by feeding back the recording medium 43. Thus, when feeding back the recording medium 43, the operation of re-heating and re-pressing is performed. Therefore, if an operation of re-heating and re-pressing is performed once, the operation of re-heating and re-pressing comes to substantially be performed two times.

Figure 9:
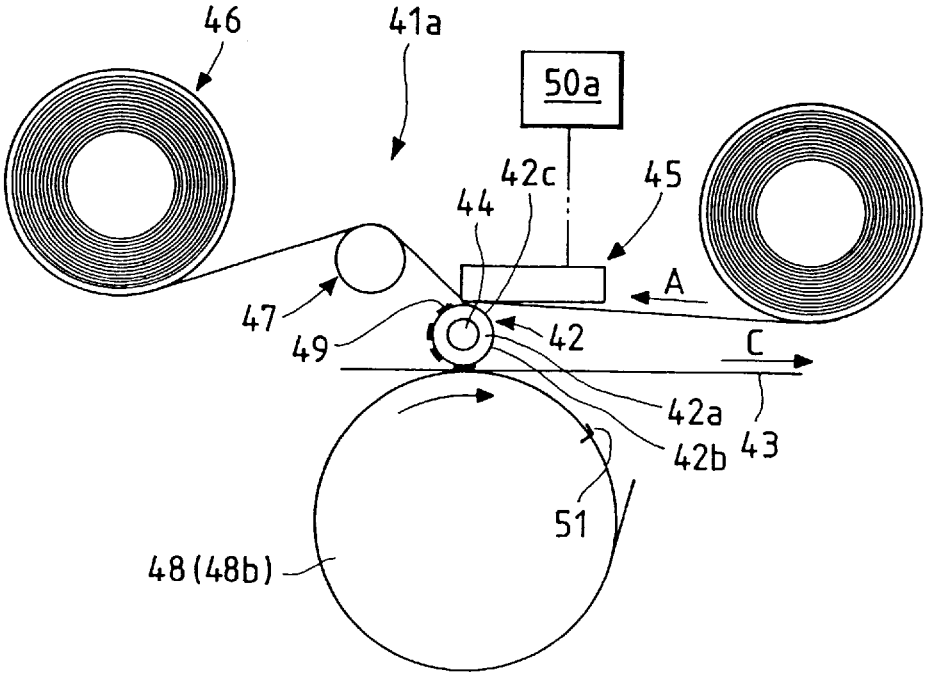
FIG. 9 is a schematic diagram for illustrating a primary part of another thermal transfer line printer, to which a printing method of the present invention is applied, namely, a sixth embodiment of the present invention.
Figure 10:
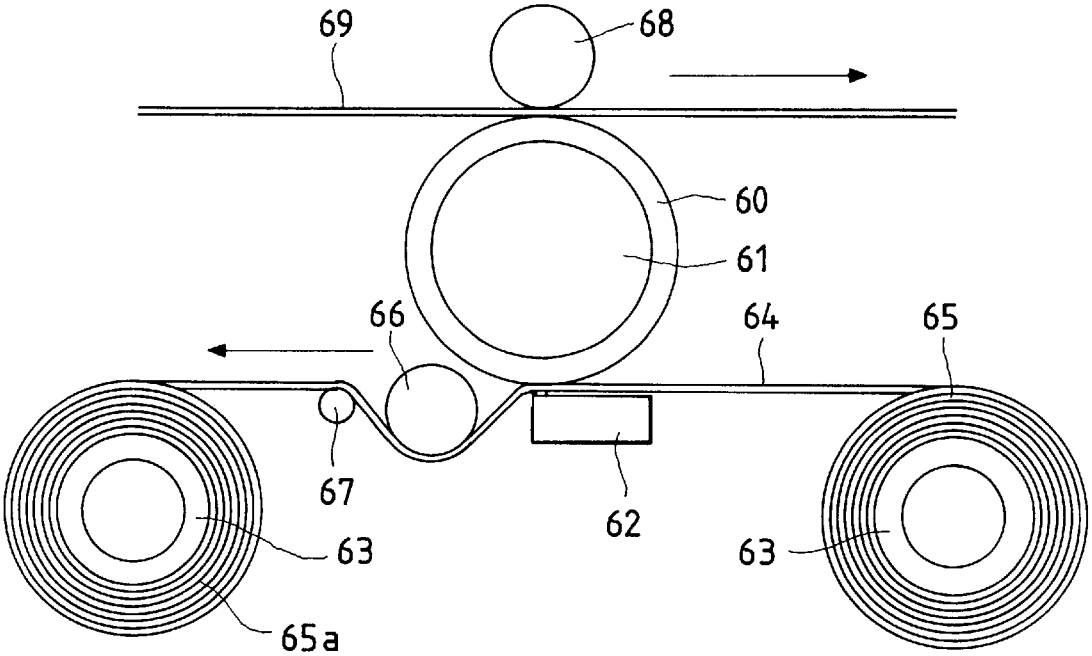
FIG. 10 PRIOR ART
FIG. 10 is a sectional view of a part of a conventional thermal transfer printer.
Figure 11:
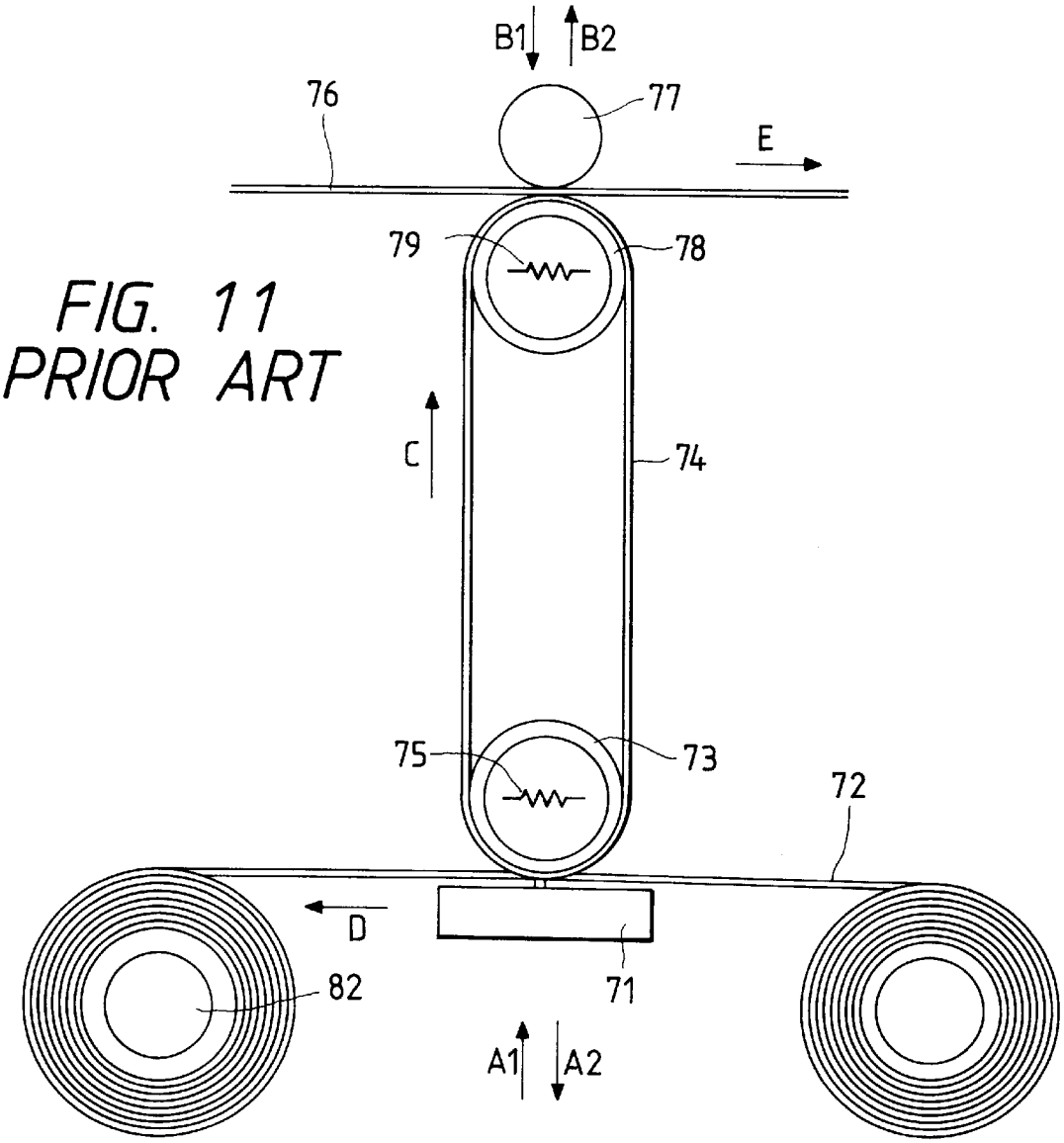
FIG. 11 PRIOR ART
FIG. 11 is a sectional view of a part of another conventional thermal transfer printer.
Figure 12:
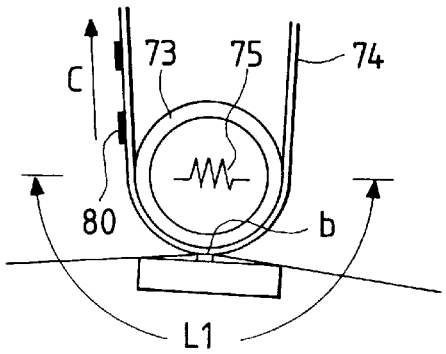
FIG. 12 PRIOR ART
FIG. 12 is a diagram for illustrating a place at which a thermal head is pressed against a platen roller of FIG. 11.

FIG. 9 is a schematic diagram for illustrating a primary part of another thermal transfer line printer embodying the present invention, namely, a sixth embodiment of the present invention.

In this thermal transfer line printer 41*a*, a drum 48*b*, around which a recording medium 43 can be put, is provided as the pressing means 48 instead of the pressure roller 48*a* of the fifth embodiment. This drum 48*b* is adapted to be able to approach and leave the intermediate transfer roller 42, similarly as the pressure roller 48*a* of the fifth embodiment. Further, a damper 51 is provided on the periphery of the drum 48*b* as a fixing means which can be opened and closed by driving force from a driving-force source (not shown). The leading end of the recording medium 43 in the running direction thereof is fixed to the surface of the drum 48*b*. Further, for the purpose of putting the recording medium 43 around the periphery of the drum 48*b*, the circumference of the drum 48*b* is established as being longer than the length of the recording medium 43. In the case where paper of the letter paper size is used as the recording medium 43, the diameter of the drum 48*b* should be equal to or more than 100 mm. Incidentally, the control portion 50*a* of this embodiment is adapted to control operations of the drum 48*b* and the damper 51 instead of controlling the operation of the pressure roller 48*a* as in the case of the fifth embodiment. However, a control operation of feeding back the recording medium 43 is excepted from objects to be controlled by the control portion 50 of the sixth embodiment. Moreover, the intermediate transfer roller 42 and the drum 48*b* may be constructed in such a manner that one of these components 42 and 48*b* drives and the other thereof is driven. Thus, the intermediate transfer roller and the drum are not limited to the corresponding components 42 and 48*b* of the sixth embodiment. The rest of the components of this embodiment are similar to the corresponding components of the aforementioned fifth embodiment.

With such a configuration, the sixth embodiment has effects similar to those of the fifth embodiment. Further, as the result of substituting the drum 48*b* for the pressure roller 48*a* differently from the fifth embodiment, the sixth embodiment of the present invention has an advantage in that an operation of transferring the primary recording image onto the recording medium and an operation of re-heating and re-pressing the image can be performed by feeding the recording medium 43 in the same direction at all times without feeding back the recording medium 43. Namely, in the case of the sixth embodiment, the operation of transferring the primary recording image onto the recording medium 43 and the operation of re-heating and re-pressing the image can be achieved in a state in which the recording medium 43 is always fed in the same direction. Thereby, in the case of the sixth embodiment, the number of times of performing the operation of transferring the primary recording image onto the recording medium 43 and the operation of re-heating and re-pressing the image can be controlled more securely and appropriately, in comparison with the fifth embodiment. Consequently, good printing quality can be obtained. Moreover, the sixth embodiment need not perform the operation of feeding back the recording medium 43. The accuracy of locating the beginning of a band or area of color ink can be further improved by the sixth embodiment. Moreover, in the case of the sixth embodiment, the printing quality in color printing can be further improved.

Incidentally, each of the foregoing embodiments of the present invention can be applied not only to a color printing apparatus (or method) but also to a monochromatic printing apparatus (or method).

Thus, the printer of the present invention has the configuration and effects as above described. Thereby, the ink ribbon can be fed by utilizing the driving force of the back-up roller and the friction between the ink ribbon and the intermediate transfer medium. Therefore, the speed, at which the ink ribbon is fed, can be made to depend upon the rotation of the back-up roller. Moreover, the rotation of the back-up roller can be synchronized with the feeding of the ink ribbon. Thus, the present invention can prevent an occurrence of deterioration in the recording precision, which would take place owing to the subtle difference between the rotating speed of the back-up roller and the speed at which the ink ribbon is fed. Additionally, if an adhesive material is used as the material of the intermediate transfer medium, what is called an ink slippage is hard to occur. Thereby, the thickness of ink can be stable and uniform. Clearer recording image can be obtained. Furthermore, the ribbon feeding mechanism can be simplified. Consequently, the miniaturization and the reduction in price of the thermal transfer printer can be achieved.

Further, in the case of the thermal transfer printer of the present invention, the ink layer of the ink ribbon can be securely transferred onto the intermediate transfer medium as the primary recording image. Moreover, the stable formation of dots can be realized. Consequently, high printing quality can be ensured.

Furthermore, in the cases of employing the thermal transfer line printer and the printing method therefor, the smoothness of ink fixed onto the recording medium can be improved by performing the operation of re-heating and re-pressing the image. Moreover, the adhesion between colored inks used for a color printing operation can be improved. Thus, the abrasion resistance of ink fixed onto the recording medium can be increased. Consequently, the present invention has excellent advantages in that good printing quality can be obtained and that the light transmittance of OHP paper can be securely increased.

Although the preferred embodiments of the present invention have been described above, it should be understood that the present invention is not limited thereto and that other modifications will be apparent to those skilled in the art without departing from the spirit of the invention.

The scope of the present invention, therefore, is to be determined solely by the appended claims.

We claim:

1. A thermal transfer printer comprising:

a thermal head for selectively causing heating elements thereof to produce heat to partially melt ink of an ink ribbon;

an intermediate transfer medium onto which the ink of the ink ribbon melted by heat produced by the thermal head is transferred to thereby form a primary recording image, the intermediate transfer medium being made of a material selected such that a coefficient of friction between the intermediate transfer medium and the ink ribbon is not less than 1.0; and a re-transfer means for transferring the primary recording image, which is transferred onto the intermediate transfer medium, onto paper to thereby produce a desired record.

2. The thermal transfer printer according to claim 1, wherein the intermediate transfer medium comprises silicon rubber.

3. A thermal transfer printer comprising:

a platen roller having a peripheral surface and a heater contained in an interior thereof;

a back-up roller;

an intermediate transfer member trained around the platen roller and the back-up roller, the intermediate transfer member having an intermediate transfer medium formed on a surface thereof; and a thermal head for transferring an ink layer of an ink ribbon onto said intermediate transfer medium which is heated while the intermediate transfer member contacts and is fed around a part of the periphery of said platen roller, wherein a transfer position, at which the ink layer of the ink ribbon is transferred onto the intermediate transfer medium by the thermal head, is set as a position along the part of the periphery of said platen roller contacted by said intermediate transfer member, at which a temperature of the intermediate transfer medium approximates a temperature suitable for transferring the ink layer to the intermediate transfer member.

4. The thermal transfer printer according to claim 3, wherein thermal transfer member comes into contact with the platen roller at an upstream point and separates from the platen roller at a downstream point, and the thermal transfer medium includes a middle portion located mid-way between the upstream point and the downstream point, and wherein the transfer position, at which the ink layer of the ink ribbon is transferred onto the intermediate transfer medium by the thermal head, is set as a position which is between the downstream point and the middle portion of the intermediate transfer medium.

5. A thermal transfer line printer comprising:

a thermal head having a plurality of heating elements that produce heat to partially melt ink of an ink sheet;

an intermediate transfer member containing a heater, the ink of the ink sheet melted by heat produced by the plurality of heating elements being transferred onto the intermediate transfer member to thereby form a primary recording image; and a pressing member which is biased against the intermediate transfer member to transfer the primary recording image formed on the intermediate transfer member onto a recording medium, the recording medium being fed between the pressing member and the intermediate transfer member by the relative rotation of the pressing member and the intermediate transfer member, the thermal transfer printer further comprising:

a control portion for driving the intermediate transfer member, the pressing member and the heater so that the image transferred onto the recording medium is re-heated and re-pressed between the intermediate transfer member and the pressing member, wherein the control portion drives the intermediate transfer member such that the recording medium is fed in a first direction when the primary recording image is transferred from the intermediate transfer member onto a recording medium, and is fed in a second direction when the recording medium is re-heated and re-pressed.

6. The thermal transfer line printer according to claim 5, wherein the control portion changes the number of times of re-heating and re-pressing of the image, which is transferred onto the recording medium, in accordance with a kind of the recording medium.

7. The thermal transfer line printer according to claim 5, wherein the control portion drives the heater such that a heating temperature at the time of re-heating and re-pressing the image transferred onto the recording medium is higher than a heating temperature at the time of transferring the primary recording image onto the recording medium.

8. A thermal transfer line printer comprising:

a thermal head having a plurality of heating elements that produce heat to partially melt ink of an ink sheet;

an intermediate transfer member containing a heater, the ink of the ink sheet melted by heat produced by the plurality of heating elements being transferred onto the intermediate transfer member to thereby form a primary recording image; and a pressing member which is biased against the intermediate transfer member to transfer the primary recording image formed on the intermediate transfer member onto a recording medium, the recording medium being fed between the pressing member and the intermediate transfer member by the relative rotation of the pressing member and the intermediate transfer member, the thermal transfer printer further comprising:

a control portion for driving the intermediate transfer member, the pressing member and the heater so that the image transferred onto the recording medium is re-heated and re-pressed between the intermediate transfer member and the pressing member, wherein the control portion changes the number of times of re-heating and re-pressing of the image, which is transferred onto the recording medium, in accordance with a kind of the recording medium.

9. A thermal transfer line printer comprising:

a thermal head having a plurality of heating elements that produce heat to partially melt ink of an ink sheet;

an intermediate transfer member containing a heater the ink of the ink sheet melted by heat produced by the plurality of heating elements being transferred onto the intermediate transfer member to thereby form a primary recording image; and a pressing member which is biased against the intermediate transfer member to transfer the primary recording image formed on the intermediate transfer member onto a recording medium, the recording medium being fed between the pressing member and the intermediate transfer member by the relative rotation of the pressing member and the intermediate transfer member, the thermal transfer printer further comprising:

a control portion for driving the intermediate transfer member, the pressing member and the heater so that the image transferred onto the recording medium is re-heated and re-pressed between the intermediate transfer member and the pressing member, wherein the control portion drives the heater such that a heating temperature at the time of re-heating and re-pressing the image transferred onto the recording medium is higher than a heating temperature at the time of transferring the primary recording image onto the recording medium.

10. A printing method for a thermal transfer line printer, comprising the steps of:

transferring ink from an ink sheet onto an intermediate transfer member and forming a primary recording image on the intermediate transfer member by selectively activating heating elements of a thermal head to melt the ink;

re-transferring the primary recording image formed on the intermediate transfer member by heating the primary recording image and pressing the primary recording image against a recording medium, thereby transferring the primary recording image such that an image is formed on the recording medium;

re-heating and re-pressing the recording medium and the image transferred thereto;

feeding the recording medium in a first direction during re-transferring; and feeding the recording medium in the first direction and in a second direction during re-heating and re-pressing.

11. The printing method for a thermal transfer line printer according to claim 10 further comprising:

repeating the re-heating and re-pressing at least once as determined in accordance with a kind of the recording medium.

12. The printing method for a thermal transfer line printer according to claim 10 further comprising:

applying heat of a first temperature during the re-transferring the primary recording image; and applying heat of a second temperature during the re-heating and re-pressing, the second temperature being greater than the first temperature.

13. A printing method for a thermal transfer line printer, comprising the steps of:

transferring ink from an ink sheet onto an intermediate transfer member and forming a primary recording image on the intermediate transfer member by selectively activating heating elements of a thermal head to melt the ink;

re-transferring the primary recording image formed on the intermediate transfer member by heating the primary recording image and pressing the primary recording image against a recording medium, thereby transferring the primary recording image such that an image is formed on the recording medium;

re-heating and re-pressing the recording medium and the image transferred thereto;

feeding the recording medium in a first direction during re-transferring; and feeding the recording medium in one of the first direction and a second direction during re-heating and re-pressing.

14. The printing method for a thermal transfer line printer according to claim 13 further comprising:

repeating the re-heating and re-pressing at least once as determined in accordance with a kind of the recording medium.

15. The printing method for a thermal transfer line printer according to claim 13 further comprising:

applying heat of a first temperature during the re-transferring the primary recording image; and applying heat of a second temperature during the re-heating and re-pressing, the second temperature being greater than the first temperature.

16. A printing method for a thermal transfer line printer, comprising the steps of:

transferring ink from an ink sheet onto an intermediate transfer member and forming a primary recording image on the intermediate transfer member by selectively activating heating elements of a thermal head to melt the ink;

re-transferring the primary recording image formed on the intermediate transfer member by heating the primary recording image and pressing the primary recording image against a recording medium, thereby transferring the primary recording image such that an image is formed on the recording medium;

re-heating and re-pressing the recording medium and the image transferred thereto;

repeating the re-heating and re-pressing at least once as determined in accordance with a kind of the recording medium.

17. A printing method for a thermal transfer line printer, comprising the steps of:

transferring ink from an ink sheet onto an intermediate transfer member and forming a primary recording image on the intermediate transfer member by selectively activating heating elements of a thermal head to melt the ink;

re-transferring the primary recording image formed on the intermediate transfer member by heating the primary recording image and pressing the primary recording image against a recording medium, thereby transferring the primary recording image such that an image is formed on the recording medium;

re-heating and re-pressing the recording medium and the image transferred thereto;

applying heat of a first temperature during the re-transferring the primary recording image; and applying heat of a second temperature during the re-heating and re-pressing, the second temperature being greater than the first temperature.

18. A thermal transfer line printer comprising:

a thermal head having a plurality of heating elements that produce heat to partially melt ink of an ink sheet;

an intermediate transfer member containing a heater, the ink of the ink sheet melted by heat produced by the plurality of heating elements being transferred onto the intermediate transfer member to thereby form a primary recording image;

a pressing member which is biased against the intermediate transfer member to transfer the primary recording image formed on the intermediate transfer member onto a recording medium, the recording medium being fed between the pressing member and the intermediate transfer member by the relative rotation of the pressing member and the intermediate transfer member; and a control portion for driving the intermediate transfer member, the pressing member and the heater so that the image transferred onto the recording medium is re-heated and re-pressed between the intermediate transfer member and the pressing member, wherein the control portion drives the pressing member such that the recording medium in fed in a first direction when the primary recording image is transferred from the intermediate transfer member onto a recording medium, and is fed in a second direction when the recording medium is re-heated and re-pressed.

19. A thermal transfer line printer comprising:

a thermal head having a plurality of heating elements that produce heat to partially melt ink of an ink sheet;

an intermediate transfer member containing a heater, the ink of the ink sheet melted by heat produced by the plurality of heating elements being transferred onto the intermediate transfer member to thereby form a primary recording image;

a pressing member which is biased against the intermediate transfer member to transfer the primary recording image formed on the intermediate transfer member onto a recording medium, the recording medium being fed between the pressing member and the intermediate transfer member by the relative rotation of the pressing member and the intermediate transfer member, and a control portion for driving the intermediate transfer member, the pressing member and the heater so that the image transferred onto the recording medium is re-heated and re-pressed between the intermediate transfer member and the pressing member, wherein the control portion drives the intermediate transfer member and the pressing member such that the recording medium in fed in a first direction when the primary recording image is transferred from the intermediate transfer member onto a recording medium, and is fed in a second direction when the recording medium is re-heated and re-pressed.

* * * * *

UNITED STATES PATENT AND TRADEMARK OFFICE

CERTIFICATE OF CORRECTION

PATENT NO. : 5,886,727

DATED : March 23, 1999

INVENTOR(S) : Koichi Dobashi et al.

It is certified that error appears in the above-identified patent and that said Letters Patent is hereby corrected as shown below:

On the Title Page

In column 2, line 1, under "FOREIGN PATENT DOCUMENTS" please replace "2/1986" with --12/1986--.

In the Claims

In claim 12, line 4, after "re-transferring" insert --of--.

In claim 15, line 4, after "re-transferring" insert --of--.

In claim 17, line 17, after "re-transferring" insert --of--.

In claim 18, line 22, replace "in" (first occurrence) with --is--.

UNITED STATES PATENT AND TRADEMARK OFFICE

CERTIFICATE OF CORRECTION

PATENT NO. : 5,886,727

DATED : Mar. 23, 1999

INVENTOR(S) : Koichi Dobashi et al

It is certified that error appears in the above-indentified patent and that said Letters Patent is hereby corrected as shown below:

Claim 19, line 23, replace "in" (first occurrence) with --is--.

Signed and Sealed this

Fifth Day of October, 1999

*Attest:*

Q. TODD DICKINSON

*Attesting Officer*

*Acting Commissioner of Patents and Trademarks*